US005794361A

United States Patent [19]

Sadler

[11] Patent Number: 5,794,361

[45] Date of Patent: Aug. 18, 1998

[54] FOOTWEAR WITH A SOLE PROVIDED WITH A DAMPER DEVICE

[75] Inventor: Marc Sadler, Venice, Italy

[73] Assignee: Sadler S.A.S. Di Marc Sadler & C., Venice, Italy

[21] Appl. No.: 665,911

[22] Filed: Jun. 19, 1996

[30] Foreign Application Priority Data

Jun. 20, 1995 [IT] Italy ..... VE95 A 000019

[51] Int. Cl.[6] ..... A43B 13/20; A43B 21/28

[52] U.S. Cl. ..... 36/29; 36/35 B

[58] Field of Search ..... 36/29, 35 B, 153, 36/93

[56] References Cited

U.S. PATENT DOCUMENTS

| | | | |
|---|---|---|---|
| 1,145,533 | 7/1915 | Wetmore | 36/153 |
| 2,488,382 | 11/1949 | Davis | 36/153 |
| 4,446,634 | 5/1984 | Johnson et al. | 36/43 X |
| 4,670,995 | 6/1987 | Huang | 36/3 B |
| 4,864,737 | 9/1989 | Marrello | 36/29 |
| 5,179,792 | 1/1993 | Brantingham | 36/29 |
| 5,230,249 | 7/1993 | Sasaki et al. | 36/29 X |
| 5,588,227 | 12/1996 | Goldston | 36/29 X |

FOREIGN PATENT DOCUMENTS 8910074 11/1989 WIPO .

*Primary Examiner*—Ted Kavanaugh
*Attorney, Agent, or Firm*—Hoffman, Wasson & Gitler

[57] ABSTRACT

A footwear with its sole provided with a damper device, comprising a first reservoir with deformable but inextensible walls and containing a substantially incompressible fluid, in a position interposed between a plantar and a tread of said sole; a second reservoir, in contact with the first reservoir, with deformable but inextensible walls and containing a substantially compressible fluid, and a third reservoir with deformable but inextensible walls, which communicates with the first reservoir via a first passage of adjustable cross-section.

12 Claims, 2 Drawing Sheets

FOOTWEAR WITH A SOLE PROVIDED WITH A DAMPER DEVICE

FIELD OF THE INVENTION

This invention relates to footwear with a sole provided with a damper device.

BACKGROUND OF THE INVENTION

Sports footwear is known with a pneumatic damper device interposed between the plantar and the tread. This damper consists substantially of an air cushion which, because of its compressibility, attenuates the impact of the foot during walking or running.

This known footwear offers high sports comfort but at the same time has limits on its use in that it does not enable the stress transmitted to the foot at the moment of impact to be distributed. To obviate this drawback, footwear has been proposed with a sole provided with a damper device comprising a first reservoir with deformable but inextensible walls, interposed between the planar and tread and containing oil, and a second reservoir also with deformable but inextensible walls positioned in a zone not exposed to the impact of the foot and communicating with the first reservoir via a passage provided with a non-return valve, in which a constriction adjustable from the outside is provided.

This footwear, which enables the stresses received at the moment of impact to be transmitted, has however other drawbacks, and in particular:

- it cannot absorb these stresses, with considerable discomfort to the user,
- it distributes the stresses within localized zones not associated with the plantar arch, ie that zone in which the damping effect is mostly required.

SUMMARY OF THE INVENTION

An object of the invention is to eliminate these drawbacks by providing footwear with a sole comprising a damper device enabling the stresses received at the moment of impact to be absorbed and to be distributed below the plantar arch.

A further object of the invention is to provide footwear comprising a damper device with personalizable characteristics.

A further object of the invention is to provide footwear in which the damping effect can be adjusted in an extremely rapid and simple manner.

A further object of the invention is to provide footwear in which this adjustment can be made automatically.

All these objects are attained according to the invention through a footwear with its sole provided with a damper device, characterised in that said damper device comprises:

- a first reservoir with deformable but inextensible walls and containing a substantially incompressible fluid, in a position interposed between a plantar and a tread of the sole;
- a second reservoir with deformable but inextensible walls and containing a substantially compressible fluid, said second reservoir being in contact with said first reservoir; and
- a third reservoir with deformable but inextensible walls, which communicates with the first reservoir via a first passage of adjustable cross-section and a unidirectional second passage extending from the third reservoir to the first reservoir.

BRIEF DESCRIPTION OF THE DRAWINGS

A preferred embodiment and two modifications thereof are described hereinafter with reference to the accompanying drawings, in which.

DESCRIPTION OF PREFERRED EMBODIMENTS

Figure 1:
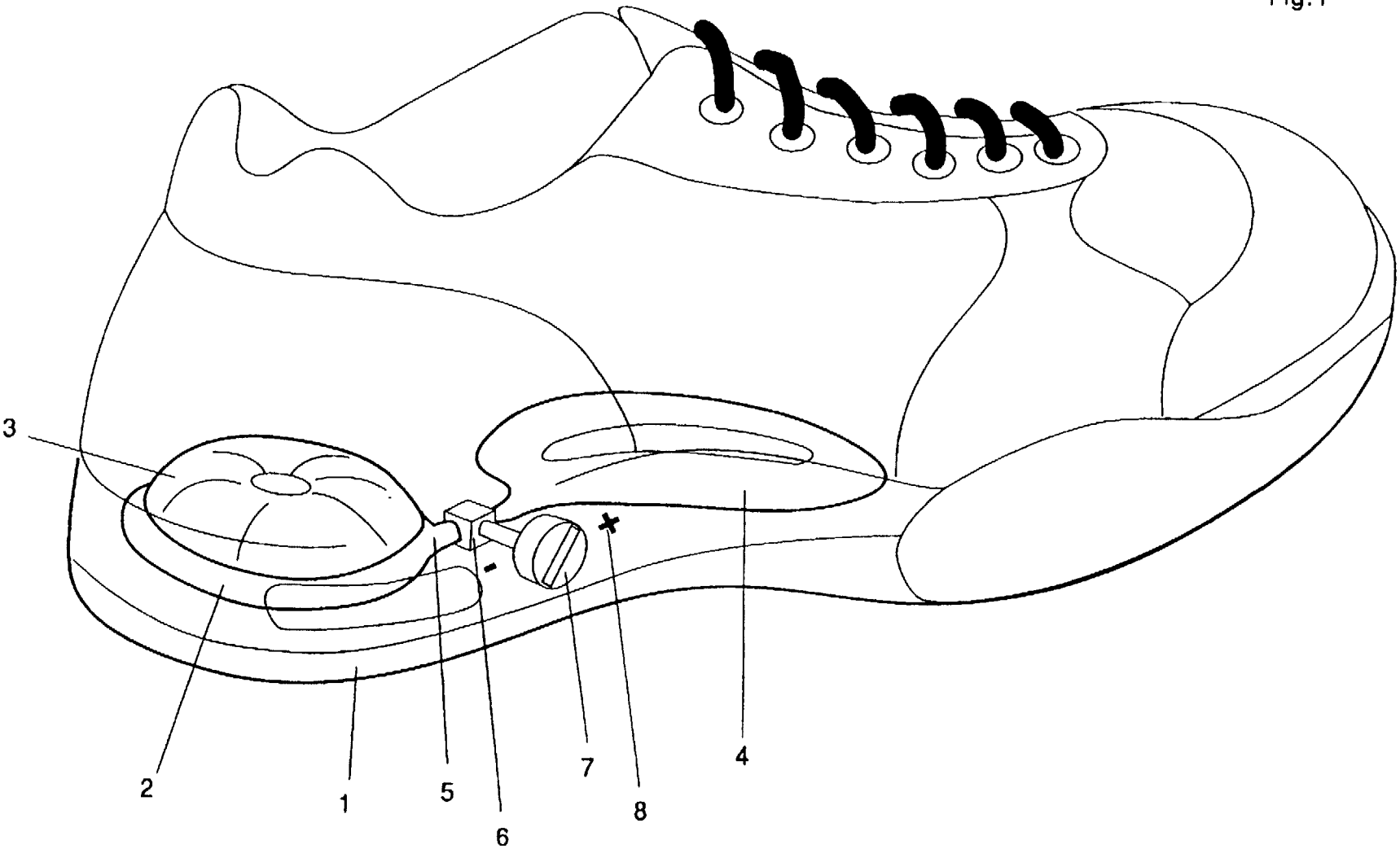
FIG. 1 is a schematic perspective view of an item of sports footwear with its sole provided with the damper device according to the invention.

As can be seen from the figures, the sports footwear according to the invention comprises, interposed between the plantar (not shown on the drawings) and the tread in correspondence with the heel zone, a flat reservoir 2 with deformable but inextensible walls, filled with an incompressible fluid, preferably oil, on the upper surface of which there rests a reservoir 3 filled with air.

A further reservoir 4 is provided in correspondence with the plantar arch and communicates with the reservoir 2 via a conduit 5 provided with a valve 6 comprising a constriction adjustable from the outside by a knob 7 provided with a pointer movable along a graduated scale 8.

Said valve 6 enables the oil to flow freely from the reservoir 4 to the reservoir 2.

In a like manner to the reservoir 2, the reservoirs 3 and 4 comprise deformable but inextensible walls.

The footwear according to the invention operates as follows:

during use, each time the weight of the sportsman presses on the plantar, it compresses the air cushion 3 which absorbs the stress due to the heel while at the same time transferring it to the underlying oil reservoir 2. This latter, because of the deformability of its inextensible walls and the incompressibility of the oil contained therein, causes the forced transfer of this oil to the reservoir 4, via the flow adjustment valve 6 which constitutes the only passage allowed. This transfer takes place at a faster or slower rate depending on the state of adjustment of said valve 6, this corresponding to a greater of lesser damping effect in response to the impact of the user's foot.

As the oil transfers to the reservoir 4 its walls yield elastically such that when the pressing action on the cushion 4 and hence on the reservoir 2 ceases, ie when the foot no longer rests on the plantar, the oil returns to the reservoir 2 via the valve 6.

In practice, the assembly formed by the reservoirs 2, 3 and 4, the conduit 5 and the valve 6 represents a sort of pneumo-hydraulic damper which effectively attenuates the impact of the sportsman's foot on the plantar while at the same time distributing this stress, the effect of which can be adjusted.

Figure 2:
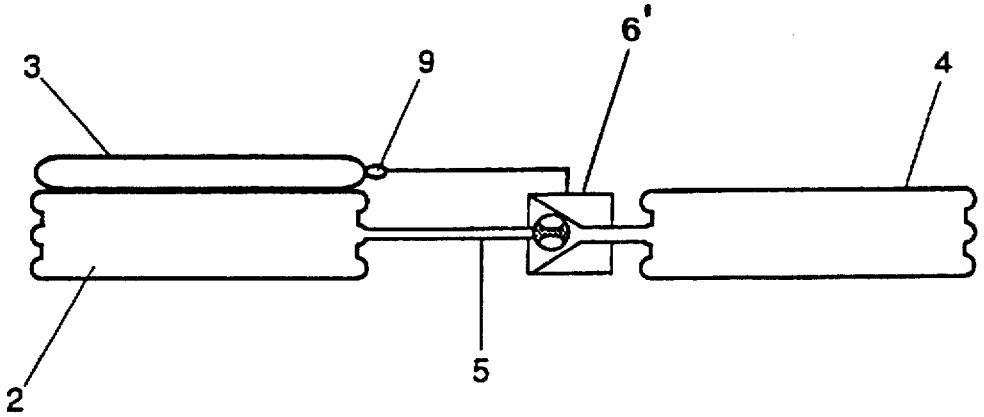
FIG. 2 is a schematic view of a first modification of its hydraulic adjustment circuit.

In the embodiment shown in FIG. 2, a pressure sensor 9 is applied to the air cushion 3 and is connected to a microvalve 6' provided in the conduit 5 connecting the two oil reservoirs 2 and 4 together.

This embodiment results in instantaneous automatic adjustment of the degree of throttling of the valve 6' and hence of the stress distribution on the basis of the stress received by the air cushion by the effect of the heel impact.

In a further embodiment the sensor 9 is positioned in contact with the oil reservoir 2.

In a different embodiment (not shown on the drawings), the valve can be connected to a microprocessor which can be programmed on the basis of the individual requirements of the user. This personalization can be achieved by means of a personalized badge or card showing all the characteristics of the user (weight, age etc.). It is also possible for the microprocessor to memorize different situations corresponding to different conditions of utilization (different sports, different running speeds etc.). In this manner the degree of throttling and hence the rate of oil transfer can be adjusted according to the sport practised.

Figure 3:
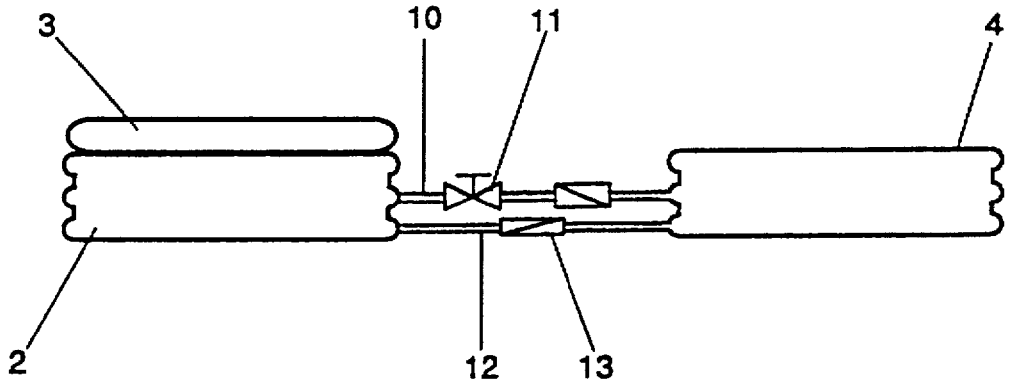
FIG. 3 is a schematic view of a second modification of its hydraulic adjustment circuit.

FIG. 3 shows schematically a different embodiment of the hydraulic circuit connecting together the two oil reservoirs 2 and 4. This circuit comprises a conduit 10 in which there is connected a flow regulator valve operable from the outside, for example by a screw, and a conduit 12 in which there is connected a non-return valve 13, ie a valve which opposes no resistance to oil transfer in the opposite direction.

This embodiment, which is constructionally more complex than the version with only one conduit, can however be advantageously used if the particular form of the footwear does not allow a unidirectional valve with an adjustable constriction to be used.

I claim:

1. A footwear having a sole provided with a damper device, wherein said damper device comprises:

a first reservoir with deformable but inextensible walls and containing a substantially incompressible fluid, in a position interposed between a plantar and a tread of said sole said first reservoir being disposed at a heel of said footwear;

a second reservoir with deformable but inextensible walls and containing a substantially compressible fluid, said second reservoir being vertically aligned with said first reservoir, with at least a wall of said first reservoir contacting a wall of said second reservoir; and a third reservoir with deformable but inextensible walls, which communicates with said first reservoir via a first passage of adjustable cross-section.

2. A footwear as claimed in claim 1, wherein said third reservoir is positioned substantially below a plantar arch of said sole.

3. A footwear as claimed in claim 1, comprising in said first passage an adjustment valve operable from outside.

4. A footwear as claimed in claim 3, wherein said valve is provided with an adjustment knob positioned in proximity to ground.

5. A footwear as claimed in claim 4, wherein said valve is provided with an adjustment knob comprising a pointer movable along a graduated scale.

6. A footwear as claimed in claim 1, further comprising a unidirectional second passage extending from said third reservoir to said first reservoir.

7. A footwear as claimed in claim 6, wherein said said first and second passages are formed in a single conduit provided with a non-return valve associated with a flow regulator device.

8. A footwear as claimed in claim 1, weherein said substantially incompressible fluid is oil.

9. A footwear as claimed in claim 1, wherein said substantially compressible fluid is air.

10. A footwear as claimed in claim 1, wherein with said second reservoir there is associated a pressure sensor which controls a microvalve positioned in said first passage between said first reservoir and said third reservoir.

11. A footwear as claimed in claim 10, wherein said pressure sensor is positioned on said first reservoir.

12. A footwear as claimed in claim 10, wherein said valve is connected to a microprocessor.

* * * * *